US009570857B2

(12) United States Patent
Morgan et al.

(10) Patent No.: US 9,570,857 B2
(45) Date of Patent: Feb. 14, 2017

(54) ELECTRICAL CONNECTOR AND INTERCONNECTION SYSTEM HAVING RESONANCE CONTROL

(71) Applicant: Tyco Electronics Corporation, Berwyn, PA (US)

(72) Inventors: Chad William Morgan, Carneys Point, NJ (US); Bruce Allen Champion, Camp Hill, PA (US); Margaret Mahoney Fernandes, West Chester, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 2 days.

(21) Appl. No.: 14/670,697

(22) Filed: Mar. 27, 2015

(65) Prior Publication Data

US 2016/0285204 A1 Sep. 29, 2016

(51) Int. Cl.
*H01R 13/648* (2006.01)
*H01R 13/6471* (2011.01)
*H01R 13/6585* (2011.01)

(52) U.S. Cl.
CPC ..... *H01R 13/6471* (2013.01); *H01R 13/6585* (2013.01)

(58) Field of Classification Search
CPC . H01R 13/514; H01R 13/518; H01R 13/6471; H01R 13/6585; H01R 13/65802; H01R 13/65807; H01R 13/6596; H01R 13/652; H01R 13/6473; H01R 13/648; H01R 13/6461
USPC ..... 439/92–108, 614, 660, 607.01–607.37, 439/79
See application file for complete search history.

(56) References Cited

U.S. PATENT DOCUMENTS 3,786,372 A * 1/1974 Epis ..... H01P 5/10 333/26
6,527,587 B1 * 3/2003 Ortega ..... H01R 23/688 439/607.05
6,786,771 B2 9/2004 Gailus
7,371,117 B2 5/2008 Gailus
7,581,990 B2 * 9/2009 Kirk ..... H01R 13/514 439/607.05
7,976,340 B1 * 7/2011 Saraswat ..... H01R 13/6587 439/108
8,083,553 B2 * 12/2011 Manter ..... H01R 13/514 439/607.05

(Continued)

*Primary Examiner* — Amy Cohen Johnson
*Assistant Examiner* — Milagros Jeancharles

(57) ABSTRACT

Electrical connector includes a connector body having a front side configured to engage a mating connector and a mounting side configured to engage an electrical component. The electrical connector also includes a conductor array including a plurality of signal conductors and a plurality of ground conductors that extend through the connector body. The plurality of signal conductors includes adjacent signal conductors and the plurality of ground conductors include first and second ground conductors that are positioned between the adjacent signal conductors. The first and second ground conductors are separated from each other by a physical gap. The electrical connector also includes first and second resonance-control elements attached to the first and second ground conductors, respectively, within the gap between grounds. The first and second resonance-control elements are spaced from each other and include at least one of an electrically-lossy or magnetically-lossy material.

20 Claims, 8 Drawing Sheets

(56) References Cited

U.S. PATENT DOCUMENTS 8,167,651 B2 * 5/2012 Glover ..... H01R 12/585 439/607.08
8,177,564 B1 5/2012 Ito et al.
8,371,875 B2 * 2/2013 Gailus ..... H01R 13/719 174/256
8,398,432 B1 * 3/2013 McClellan ..... H01R 13/6587 439/607.07
8,523,583 B2 9/2013 Ito
8,764,464 B2 7/2014 Buck et al.
8,771,016 B2 * 7/2014 Atkinson ..... H01R 13/6474 439/607.07
8,777,663 B2 * 7/2014 Annis ..... H01R 13/518 439/607.05
8,801,464 B2 * 8/2014 McNamara ..... H01R 13/6461 439/607.07
8,814,595 B2 * 8/2014 Cohen ..... H01R 13/6461 439/607.07
8,905,786 B2 * 12/2014 Davis ..... H01R 13/6587 439/108
9,219,335 B2 * 12/2015 Atkinson
2003/0022555 A1 * 1/2003 Vicich ..... H01R 23/688 439/607.05
2004/0121652 A1 * 6/2004 Gailus ..... H05K 1/0233 439/607.01
2010/0144201 A1 * 6/2010 Defibaugh ..... H01R 13/514 439/607.05
2012/0135615 A1 * 5/2012 Mizukami ..... H01R 13/6587 439/108
2013/0196553 A1 * 8/2013 Gailus ..... H01R 13/719 439/660
2014/0127946 A1 5/2014 Ito et al.
2015/0056856 A1 * 2/2015 Atkinson ..... H01R 13/6471 439/607.06

* cited by examiner

ELECTRICAL CONNECTOR AND INTERCONNECTION SYSTEM HAVING RESONANCE CONTROL

BACKGROUND

The subject matter herein relates generally to electrical connectors that have signal conductors configured to convey data signals and ground conductors that control impedance and reduce crosstalk between the signal conductors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors control impedance and reduce crosstalk between the signal conductors. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal integrity. For example, in some cases, electrical energy that flows on the surface of each ground conductor of the electrical connector may be reflected and resonate within cavities formed between ground conductors. Unwanted electrical energy may be supported between one ground conductor and nearby ground conductors. Depending on the frequency of the data transmission, electrical noise may develop that increases return loss and/or crosstalk and reduces throughput of the electrical connector.

To control resonance in between conductors and limit the effects of the resulting electrical noise, it has been proposed to electrically common separate ground conductors using a metal conductor or a lossy plastic material. The effectiveness and/or cost of implementing these techniques is based on a number of variables, such as the geometry of the electrical connector and geometries of the signal and ground conductors within the electrical connector. For some applications and/or electrical connector configurations, alternative methods for controlling resonance between the ground conductors may be desired.

Accordingly, there is a need for electrical connectors that reduce the electrical noise caused by resonating conditions between ground conductors.

BRIEF DESCRIPTION

In an embodiment, an electrical connector is provided that includes a connector body having a front side configured to engage a mating connector and a mounting side configured to engage an electrical component. The electrical connector also includes a conductor array including a plurality of signal conductors and a plurality of ground conductors that extend through the connector body to interconnect the mating connector and the electrical component. The plurality of signal conductors includes adjacent signal conductors, and the plurality of ground conductors include first and second ground conductors that are positioned between the adjacent signal conductors. The first and second ground conductors are separated from each other by a physical gap.

The electrical connector also includes a resonance-control element that is positioned between the first and second ground conductors within the physical gap. The resonance-control element directly interfaces with the first ground conductor and is spaced from the second ground conductor. The resonance-control element includes at least one of an electrically-lossy or magnetically-lossy material.

Optionally, the resonance-control element may be a first resonance-control element. The electrical connector may also include a second resonance-control element that directly interfaces with the second ground conductor. The first and second resonance-control elements are spaced from each other.

In one aspect, the signal conductors form a plurality of signal pairs that are configured to carry differential signals. The first and second ground conductors may be positioned between adjacent signal pairs. Optionally, the conductor array includes a plurality of conductor sub-assemblies. Each conductor sub-assembly may include one of the signal pairs and at least one of the ground conductors. Optionally, the conductor array may include a plurality of conductor sub-assemblies. Each of the conductor sub-assemblies may include one of the signal pairs and one of the ground conductors. The one ground conductor of a respective conductor sub-assembly may be shaped to at least partially surround the one signal pair of the respective conductor sub-assembly.

In another aspect, the resonance-control element is one of coated onto the first ground conductor, molded with the connector body, or molded directly onto the first ground conductor. By way of example, the resonance-control element may include a dielectric material having conductive and/or magnetic particles dispersed within the dielectric material.

In an embodiment, an electrical connector is provided that includes a connector body having a front side configured to engage a mating connector and a mounting side configured to engage an electrical component. The electrical connector also includes a conductor array including a plurality of signal conductors and a plurality of ground conductors that extend through the connector body to interconnect the mating connector and the electrical component. The plurality of signal conductors includes adjacent signal conductors, and the plurality of ground conductors include an intervening ground conductor that is positioned between the adjacent signal conductors. The electrical connector may also include a resonance-control element that directly interfaces with the intervening ground conductor and is positioned between and spaced from the adjacent signal conductors. The resonance-control element may be spaced from the other ground conductors and include at least one of an electrically-lossy or magnetically-lossy material. Optionally, the signal conductors may form a plurality of signal pairs that are configured to carry differential signals. The intervening ground conductor and the resonance-control element may be positioned between adjacent signal pairs.

In an embodiment, an electrical connector is provided that includes a front housing having a front side configured to engage a mating connector. The front housing includes a dielectric material and has signal and ground channels that open to the front side. The electrical connector may also include signal and ground contacts that are disposed within the front housing and align with the signal and ground channels, respectively, for engaging signal and ground conductors, respectively, of the mating connector. The electrical connector may also include resonance-control elements having an electrically-lossy and/or magnetically-lossy material.

The resonance-control elements partially define the ground channels. Each of the resonance-control elements is configured to directly interface with a corresponding ground conductor of the mating connector when the mating connector and the electrical connector are fully mated. The resonance-control elements are spaced apart from one another.

DETAILED DESCRIPTION

Figure 1:
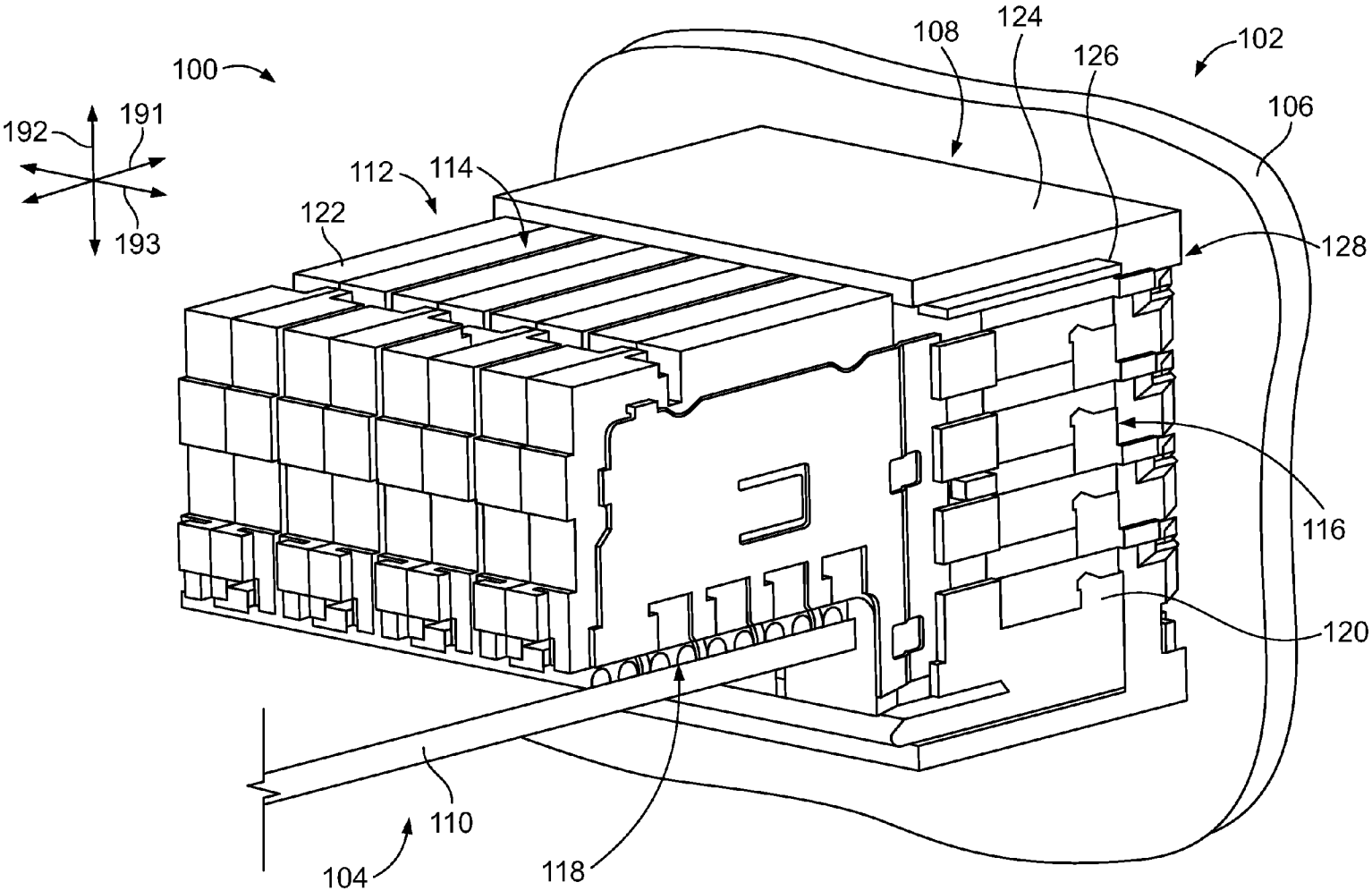
FIG. 1 is a perspective view of an interconnection system formed in accordance with an embodiment that includes a header connector and a receptacle connector that are mated with each other.

Embodiments set forth herein may include interconnection systems and electrical connectors that are configured for communicating data signals. An electrical connector may mate with a corresponding electrical connector, which may be referred to herein as a mating connector, to communicatively interconnect different components of an interconnection system. In some embodiments, the electrical connector is a header connector of a backplane or midplane interconnection system. In other embodiments, the electrical connector is a receptacle connector that is configured to mate with a header connector of a backplane or midplane interconnection system. However, the inventive subject matter set forth herein may also be applicable in other types of electrical connectors. The electrical connectors typically include a plurality of signal conductors, a plurality of ground conductors, and a plurality of resonance-control elements. The resonance-control elements are configured to directly interface with corresponding ground conductors of the electrical connector and/or the ground conductors of the mating connector. As used herein, a resonance-control element "directly interfaces with" a corresponding ground conductor if the resonance-control element engages (e.g., is attached to or pressed against) the corresponding ground conductor or if a nominal tolerance space exists between the resonance-control element and the corresponding ground conductor. The resonance-control elements may reduce electrical noise caused by resonating conditions between ground conductors of the electrical connector and/or the ground conductors of the mating connector.

The signal and ground conductors are positioned relative to each other to form a predetermined array or pattern. In some embodiments, the pattern or array includes multiple rows and/or columns. The signal conductors of a single row or column may be substantially co-planar. The ground conductors of a single row or column may be substantially co-planar. In an exemplary embodiment, the signal conductors form signal pairs in which each signal pair is separated from an adjacent signal pair by one or more ground conductors. As used herein, the phrase "adjacent signal conductors" means first and second signal conductors that do not have any other signal conductors positioned between the first and second signal conductors. Likewise, as used herein, the phrase "adjacent signal pairs" means first and second signal pairs that do not have any other signal pairs positioned between the first and second signal pairs. It should be understood, however, that a single signal pair may be adjacent to more than one signal pair. For instance, the single signal pair may be positioned between two other signal pairs. In this example, the signal pair is adjacent to the signal pair on one side and adjacent to the signal pair on the opposite side.

The ground conductors are positioned between adjacent signal conductors (or signal pairs) to electrically separate the signal conductors (or signal pairs) and reduce electromagnetic interference or crosstalk. As used herein, a ground conductor is "positioned between" adjacent signal conductors or pairs if at least a portion of the ground conductor is positioned between the adjacent signal conductors or pairs. The ground conductor is positioned between the adjacent signal conductors or pairs if a line extending between the adjacent signal conductors or pairs intersects the ground conductor.

In some embodiments, a single ground conductor may be shaped to at least partially surround a corresponding signal conductor or corresponding signal pair. For example, the ground conductor may include multiple conductor walls that are positioned to provide the ground conductor with a U-shape, C-shape, L-shape, or rectangular shape structure. In other embodiments, multiple ground conductors may be positioned to at least partially surround a corresponding signal conductor or corresponding signal pair. Optionally, the resonance-control elements may be secured directly to the corresponding ground conductors. Alternatively, the resonance-control elements may be removably coupled or attached to the corresponding ground conductors. The resonance-control elements may comprise an electrically-lossy and/or magnetically-lossy material that absorbs unwanted electrical energy supported by ground conductors. In some cases, the absorbed energy may be dissipated as heat.

In order to distinguish similar elements in the detailed description and claims, various labels may be used. For example, an electrical connector may be referred to as a header connector, a receptacle connector, a mating connector, etc. Conductors may be referred to as signal conductors, ground conductors, etc. When similar elements are labeled differently, the different labels do not necessarily require structural differences.

As used herein, the phrases "a plurality of [elements]," "an array of [elements]," and the like, when used in the detailed description and claims, do not necessarily include each and every element that a component, such as an electrical connector or interconnection system, may have. For instance, the phrase "a plurality of ground conductors having [a recited feature]" does not necessarily mean that each and every ground conductor of the corresponding electrical connector (or interconnection system) has the recited feature. Other ground conductors of the electrical connector may not include the recited feature. Accordingly, unless explicitly stated otherwise (e.g., "each and every ground conductor of the electrical connector"), embodiments may include similar elements that do not have the recited features.

FIG. 1 is a perspective view of an interconnection system 100 formed in accordance with an embodiment. The interconnection system 100 includes a first circuit board assembly 102 and a second circuit board assembly 104 that are communicatively coupled to one another. The first circuit board assembly 102 includes a circuit board 106 and an electrical connector 108 mounted thereto. The second circuit board assembly 104 includes a circuit board 110 and an electrical connector 112 mounted thereto. In particular embodiments, the interconnection system 100 may be a backplane or midplane interconnection system such that the first circuit board assembly 102 forms a backplane or midplane assembly, and the second circuit board assembly 104 forms a daughter card assembly. The daughter card assembly may be referred to as a line card or a switch card. The electrical connectors 108, 112 may be referred to as header and receptacle connectors, respectively, in some embodiments. In the illustrated embodiment, only a single electrical connector 108 is shown mounted to the circuit board 106 and only a single electrical connector 112 is shown mounted to the circuit board 110. In other embodiments, the first circuit board assembly 102 may include multiple electrical connectors 108, and the second circuit board assembly 104 may include multiple electrical connectors 112.

The interconnection system 100 may be used in various applications that utilize ground conductors for controlling impedance and reducing crosstalk between signal conductors. By way of example only, the interconnection system 100 may be used in telecom and computer applications, routers, servers, and supercomputers. One or more of the electrical connectors described herein may be similar to electrical connectors of the STRADA Whisper or Z-PACK TinMan product lines developed by TE Connectivity. The electrical connectors may be capable of transmitting data signals at high speeds, such as 5 gigabits per second (Gb/s), 10 Gb/s, 20 Gb/s, 30 Gb/s, or more. In more particular embodiments, the electrical connectors may be capable of transmitting data signals at 40 Gb/s, 50 Gb/s, or more. The electrical connectors may include high-density arrays of signal conductors that engage corresponding contacts of a mating connector. A high-density array may have, for example, at least 12 signal conductors per 100 $mm^2$ along a front side of the electrical connector. In more particular embodiments, the high-density array may have at least 20 signal conductors per 100 $mm^2$ along the front side of the electrical connector.

As shown in FIG. 1, the interconnection system 100 is oriented with respect to mutually perpendicular axes 191, 192, 193, including a mating axis 191, a first lateral axis 192, and a second lateral axis 193. It should be understood that the interconnection system 100 may have any orientation with respect to gravity. For example, the first lateral axis 192 may extend parallel to a gravitational force direction in some embodiments, or the mating axis 191 may extend parallel to the gravitational force direction in other embodiments.

The electrical connector 112 includes a connector body 114 having a front side 116 configured to engage the electrical connector 108 and a mounting side 118 configured to engage an electrical component, which is the circuit board 110 in FIG. 1. In other embodiments, however, the mounting side 118 may engage another electrical component, such as another electrical connector or a communication device that is capable of electrically coupling to the electrical connector 112. The connector body 114 may be a single physical structure or a plurality of discrete structures that are assembled together to form a unitary structure. For example, in the illustrated embodiment, the connector body 114 includes a front housing or shroud 120 and a plurality of connector sub-modules 122. The electrical connector 112 includes eight (8) connector sub-modules 122 in the illustrated embodiment, but may include fewer or more connector sub-modules in other embodiments. As shown, the connector sub-modules 122 are stacked side-by-side along the second lateral axis 193. The front housing 120 is secured to the stacked connector sub-modules 122 to hold the connector sub-modules 122 as a group.

In the illustrated embodiment, the mounting side 118 faces along the first lateral axis 192, and the front side 116 faces along the mating axis 191. In other embodiments, the mounting side 118 and the front side 116 may face in opposite directions along the mating axis 191. Collectively, the connector sub-modules 122 form the mounting side 118. In alternative embodiments, the electrical connector 112 does not include multiple connector sub-modules. Instead, the electrical connector 112 may include only a single module body that is coupled to the front housing 120. Yet in other embodiments, the electrical connector 112 does not include the front housing 120.

The electrical connector 108 includes a connector body 124 having a front side 126 configured to engage the electrical connector 112 and a mounting side 128 configured to engage an electrical component, which is the circuit board 106 in FIG. 1. In other embodiments, however, the mounting side 128 may engage another electrical component, such as another electrical connector or a communication device that is capable of electrically coupling to the electrical connector 108. In the illustrated embodiment, the connector body 124 comprises a single continuous piece of dielectric material that is, for example, molded to include the features illustrated and described herein. In other embodiments, the connector body 124 may be similar to the connector body 114 and include multiple discrete structures that are coupled to one another.

Figure 2:
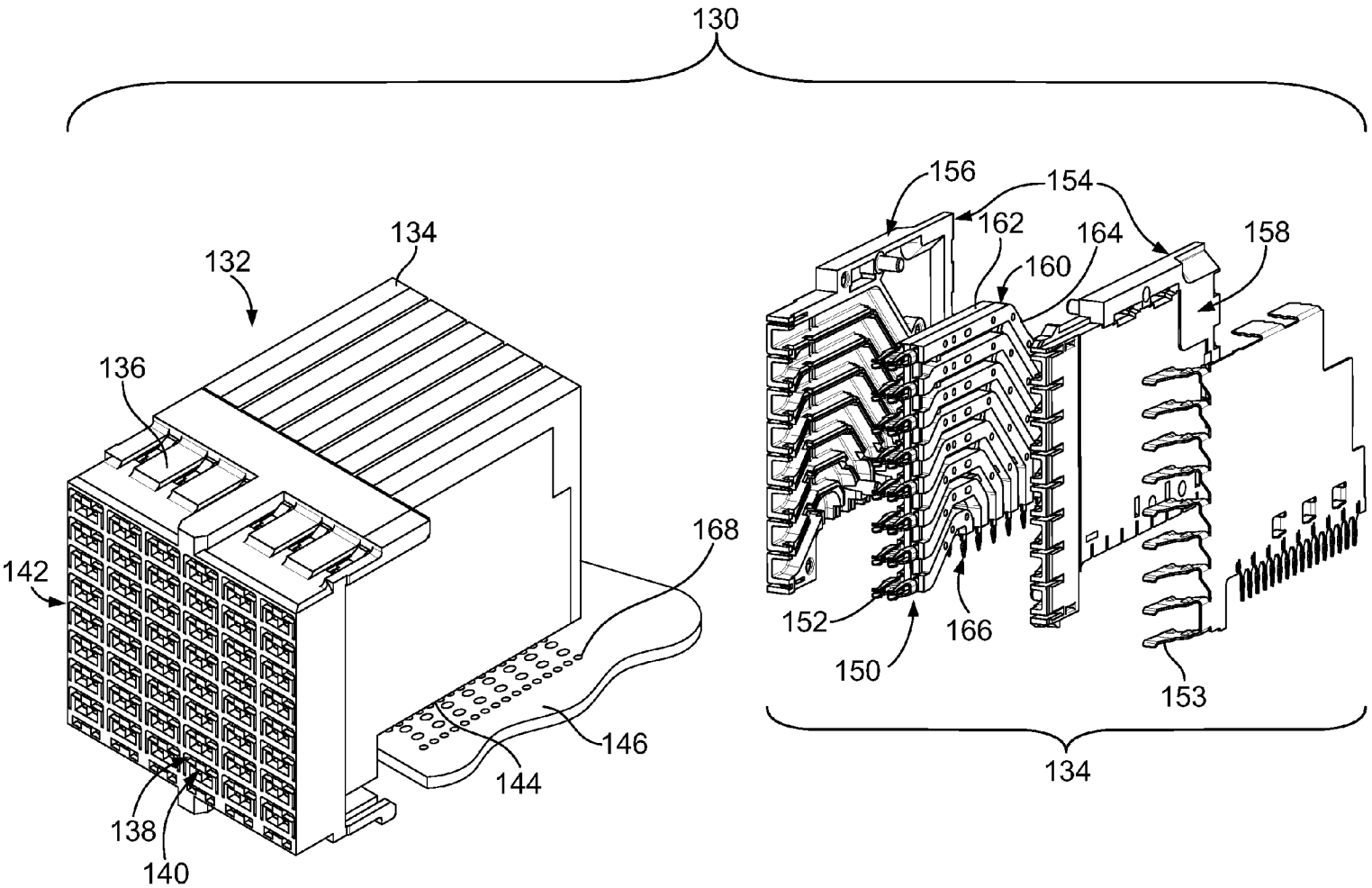
FIG. 2 is a partially exploded view of an electrical connector formed in accordance with an embodiment.

FIG. 2 is a partially exploded view of a circuit board assembly 130. The second circuit board assembly 104 (FIG. 1) may be similar to the circuit board assembly 130 and include the same or similar components. The circuit board assembly 130 includes an electrical connector 132 having a plurality of connector sub-modules 134, which may be similar or identical to the connector sub-modules 122 (FIG. 1). The connector sub-modules 134 are received within a front housing 136. The front housing 136 has a front side 142 and a plurality of contact channels 138, 140 that open to the front side 142. The front side 142 defines a mating interface of the electrical connector 132 that engages another electrical connector, such as the electrical connector 108 (FIG. 1). Also shown, the electrical connector 132 includes a mounting side 144 that is mounted onto a circuit board 146.

FIG. 2 illustrates one of the connector sub-modules 134 in an exploded state. The connector sub-module 134 includes a plurality of signal conductors 150. Each signal conductor 150 extends between a pair of contact beams 152 and a mounting contact 166. The connector sub-module 134 also includes a plurality of ground contacts 153. The connector sub-modules 134 are coupled to the front housing 136 such that the contact beams 152 are received in corresponding contact channels 140 and the ground contacts 153 are received in corresponding contact channels 138. Optionally, a single contact beam 152 may be received in each contact channel 140. The contact channels 140 are also configured to receive corresponding signal contacts of a mating electrical connector (not shown) during a mating operation. Such signal contacts may be similar or identical to the signal contacts 214 (shown in FIG. 3).

The front housing 136 may be manufactured from a dielectric material, such as a plastic material, and may provide isolation between the contact channels 138 and the contact channels 140. In some embodiments, the connector sub-module 134 includes a conductive holder 154. The conductive holder 154 may include a first holder member 156 and a second holder member 158 that are coupled together. The first and second holder members 156, 158 may be fabricated from a conductive material. As such, the first and second holder members 156, 158 may provide electrical shielding for the electrical connector 132. When the first and second holder members 156, 158 are coupled together, the first and second holder members 156, 158 define at least a portion of a shielding structure.

The conductive holder 154 is configured to support a frame assembly 160 that includes a pair of dielectric frames 162, 164. The dielectric frames 162, 164 are configured to surround the signal conductors 150. As shown, the contact beams 152 and the mounting contacts 166 clear the dielectric frames 162, 164. The mounting contacts 166 are configured to mechanically engage and electrically couple to conductive vias 168 of the circuit board 146. Each of the contact beams 152 is electrically coupled to a corresponding mounting contact 166 through the corresponding signal conductor 150.

Figure 3:
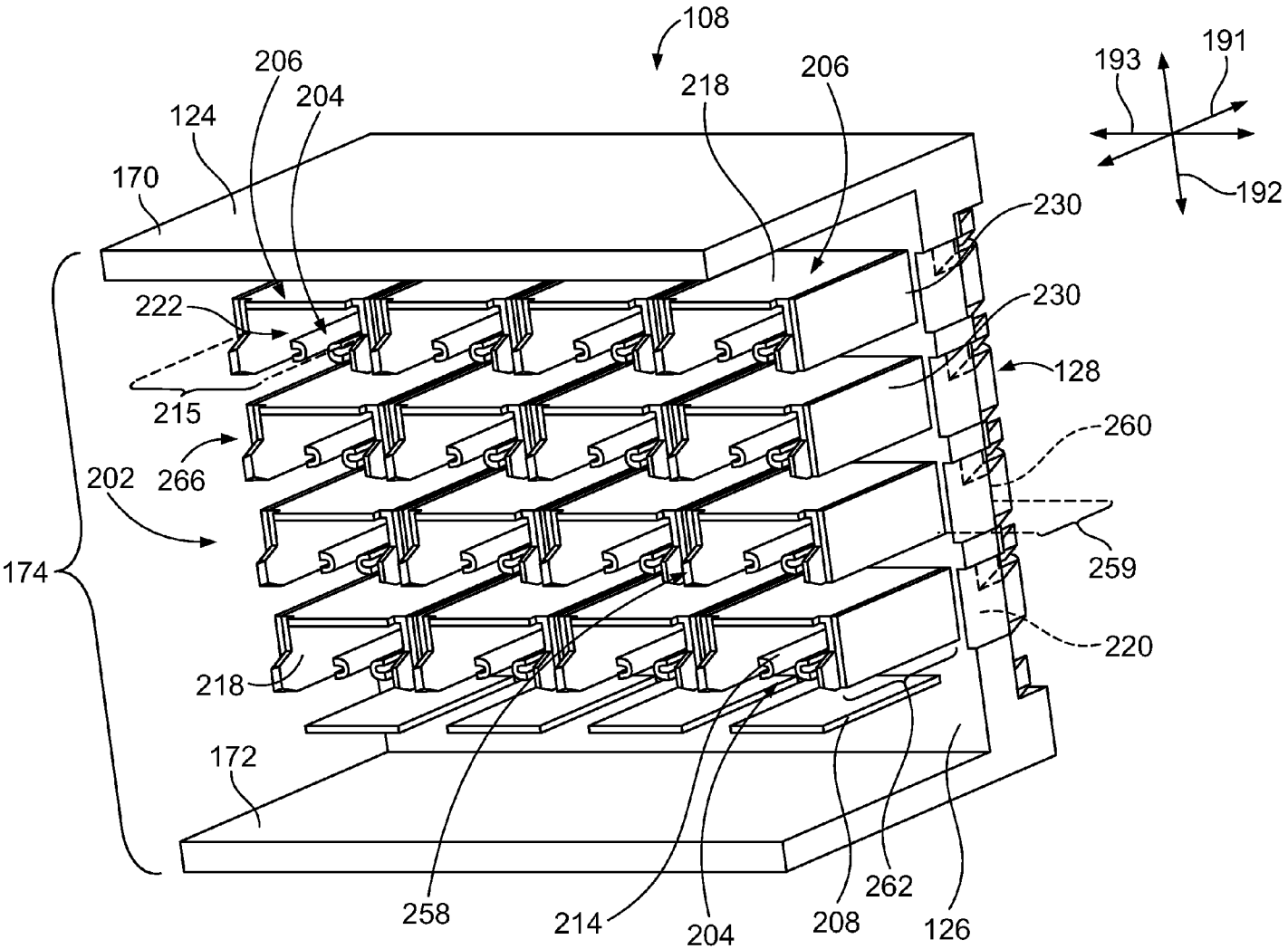
FIG. 3 is a front perspective view of the header connector of FIG. 1 and illustrates a conductor array of signal and ground conductors.

FIG. 3 is an isolated perspective view of the electrical connector 108 formed in accordance with an embodiment. As shown, the connector body 124 includes a pair of body walls 170, 172 that extend away from the front side 126 along the mating axis 191. The body walls 170, 172 define a receiving space 174 therebetween that is sized and shaped to receive the front housing 120 (FIG. 1) of the electrical connector 112 (FIG. 1). In the illustrated embodiment, the receiving space 174 is open-sided such that only the opposing body walls 170, 172 define the receiving space 174. In other embodiments, the connector body 124 may include one additional body wall (not shown) that extends between the body walls 170, 172 along the first lateral axis 192 or two additional body walls (not shown) that oppose each other and extend between the body walls 170, 172 along the first lateral axis 192. Accordingly, the receiving space 174 may be partially surrounded or entirely surrounded by the connector body 124.

The electrical connector 108 includes a conductor array 202 that is coupled to the connector body 124 and positioned within the receiving space 174. The conductor array 202 includes a plurality of signal conductors 204 and a plurality of ground conductors 206, 208 that are configured to engage corresponding contacts (not shown) of the electrical connector 112 (FIG. 1). The signal conductors 204 and the ground conductors 206, 208 are secured to the conductor body 124 in fixed positions. The signal conductors 204 and the ground conductors 206, 208 extend through the connector body 124 between the front and mounting sides 126, 128. The signal conductors 204 and the ground conductors 206, 208 may clear each of the front and mounting sides 126, 128 for engaging the electrical connector 112 (FIG. 1) and the circuit board 106 (FIG. 1) proximate to the front side 126 and the mounting side 128, respectively. As shown, the signal conductors 204 and the ground conductors 206, 208 project from the front side 126 into an exterior of the connector body 124 within the receiving space 174. In alternative embodiments, the connector body 124 may include corresponding contact channels (not shown), such as the contact channels 138, 140 (FIG. 2), and the signal conductors 204 and the ground conductors 206, 208 may be disposed within the corresponding contact channels.

The signal conductors 204 and the ground conductors 206, 208 are configured to have a designated shape and are arranged in a predetermined pattern for engaging the electrical connector 112 (FIG. 1) and the circuit board 106 (FIG. 1). To this end, each of the signal conductors 204 and each of the ground conductors 206, 208 include a portion that engages the electrical connector 112 and a portion that engages the circuit board 106. In the illustrated embodiment, each of the signal conductors 204 includes a signal contact 214, a signal terminal 213 (shown in FIG. 6), and a body portion 216 (shown in FIG. 6) that extends between the signal contact 214 and the signal terminal 213. Each of the ground conductors 206 includes a ground shield 218, a ground terminal 219 (shown in FIG. 6), and a body portion 220 (shown in phantom in FIG. 3) that extends between the ground shield 218 and the ground terminal 219.

In the illustrated embodiment, the conductor array 202 is a two-dimensional array having multiple columns and rows that extend along the first and second lateral axes 192, 193, respectively. In other embodiments, the conductor array 202 may be a one-dimensional array that includes a single row or column of signal and ground conductors 204, 206. In particular embodiments, the conductor array 202 is a high-density array. For example, the conductor array 202 may include at least 12 signal conductors 204 per 100 $mm^2$ along the front side 126 of the electrical connector 108. In more particular embodiments, the conductor array 202 may include at least 20 signal conductors 204 per 100 $mm^2$ along the front side 126 of the electrical connector 108.

The signal and ground conductors 204, 206 are arranged to form a plurality of conductor sub-assemblies 215. The conductor array 202 may include multiple rows 266 of the conductor sub-assemblies 215 in which each row 266 includes a plurality of the conductor sub-assemblies 215 arranged along the second lateral axis 193. In the illustrated embodiment, each of the conductor sub-assemblies 215 includes two signal conductors 204, which form a signal pair 222, and a corresponding ground conductor 206. Each ground conductor 206 may be shaped to surround the corresponding signal pair 222. For example, the ground conductors 206 are C-shaped or U-shaped in the illustrated embodiment. In other embodiments, however, one or more of the ground conductors 206 may be L-shaped or rectangular-shaped such that the ground conductor forms a box that completely surrounds the signal pair 222. Alternatively, each ground conductor 206 may be assembled from multiple discrete ground blades that are positioned to surround the corresponding signal pair 222. Although the conductor sub-assemblies 215 are shown and described as including a signal pair 222 and a corresponding ground conductor 206, embodiments are not required to include signal pairs. For example, embodiments may include conductor sub-assemblies having only one signal conductor that is surrounded by one or more ground conductors.

In the illustrated embodiment, the signal contacts 214 and the ground shields 218 represent the portions of the signal conductors 204 and the ground conductors 206, respectively, which are positioned within the receiving space 174. For example, each of the signal contacts 214 and the ground shields 218 project from the front side 126 in a forward direction along the mating axis 191 such that the signal contacts 214 and the ground shields 218 clear the dielectric material of the connector body 124 and are exposed for engaging corresponding contacts of the electrical connector 112 (FIG. 1). The body portions 216 (FIG. 6) and the body portions 220 represent the portions of the signal and ground conductors 204, 206, respectively, that extend through the connector body 124.

Also shown in FIG. 3, the electrical connector 108 includes resonance-control elements 230 that are attached to the ground conductors 206. In the illustrated embodiment, each resonance-control element 230 is attached to a corresponding ground shield 218 within the receiving space 174. Optionally, the resonance-control elements 230 may also be attached to corresponding body portions 220 within the connector body 124. In particular embodiments, the resonance-control element 230 may be attached to the ground shield 218 and the body portion 220. Alternatively, the resonance-control element 230 may be attached to only one of the ground shield 218 or the body portion 220.

During operation of the electrical connector 108, electrical energy may exist between the vertical side walls of ground conductors 206. For example, as the electrical energy propagates through the signal conductors 204 between the corresponding signal terminals 213 (FIG. 6) and the corresponding signal contacts 214, the parallel vertical sides of ground conductors 206 may support electrical energy that radiates from the signal conductors 204. The ground conductors 206 and the space between plated thru-holes (not shown) of the circuit board 106 (FIG. 1) and corresponding ground contacts (not shown) of the electrical connector 112 can form a resonant cavity. As electrical energy propagates within the resonant cavity along the mating axis 191, reflections between the circuit board 106 (FIG. 1) and the electrical connector 112 (FIG. 1) can occur and be supported by the parallel vertical side walls of ground conductors 206.

Without the resonance-control elements 230, such reflections may form a standing wave (or resonating condition) at certain frequencies. The standing wave (or resonating condition) may cause electrical noise that, in turn, may increase return loss and/or crosstalk and reduce throughput of the electrical connector 108. The resonance-control elements 230 are configured to impede the development of these standing waves (or resonating conditions) at certain frequencies and, consequently, reduce the unwanted effects of the electrical noise. For example, in some embodiments, the resonance-control elements 230 may absorb some of the electrical energy that propagates through the corresponding ground cavity and dissipate the electrical energy as heat. In some embodiments, the resonance-control elements 230 effectively change or dampen the reflections such that the standing wave (or the resonating condition) is not formed during operation of the electrical connector 108.

The resonance-control elements 230 are separate from each other and comprise at least one of an electrically-lossy or magnetically-lossy material. An electrically-lossy material is able to conduct electrical energy, but with at least some loss. The electrically-lossy material is less conductive than the ground conductor 206 that the resonance-control element 230 is attached to. For example, the signal and ground conductors 204, 206 may be stamped and formed from a copper alloy or other suitable metal that is capable of transmitting data signals at a commercially desirable data rate. The electrically-lossy material of the resonance-control elements 230 is less conductive than the material that forms the signal and ground conductors 204, 206.

Electrically-lossy materials are generally formed using a dielectric material having conductive particles (or fillers) dispersed within the dielectric material. The dielectric material, such as a polymer or epoxy, is used as a binder to hold the conductive particle filler elements in place. These conductive particles then impart loss to the overall electrically-lossy material.

The frequency range of interest may depend on the operating parameters of the interconnection system in which the electrical connector is used. For example, the frequency range of interest, for some embodiments, may be between direct current (DC) and 50 GHz, but it should be understood that higher frequencies may be used in other embodiments. Some electrical connectors or interconnection systems may have frequency ranges that span only a limited portion of the above range, such as about DC-20 GHz. In some embodiments, the electrical connectors may be configured for broadband data transmission. As used herein, the "electric loss tangent" is a ratio of an imaginary part to a real part of a complex electrical permittivity of the material of interest. Examples of materials that may be used are those that have an electric loss tangent between approximately 1.0 and 10.0 over the frequency range of interest. As used herein, the "magnetic loss tangent" is a ratio of an imaginary part to a real part of a complex magnetic permeability of the material of interest. Examples of materials that may be used are those that have a magnetic loss tangent above 1.0.

Resonance-control elements can also include material that is generally thought of as conductive, but is either a relatively poor conductor over the frequency range of interest, contains particles that are sufficiently dispersed in a dielectric such that the particles do not provide a high conductivity, or is otherwise prepared with properties that lead to a relatively weak bulk conductivity over the frequency range of interest. Electrically-lossy material may be partially conductive, such as material having a bulk conductivity of between 5 Siemens per meter and 50 Siemens per meter.

In some embodiments, electrically-lossy material is formed by mixing a binder with a filler that includes conductive particles. Examples of conductive particles that may be used as a filler to form electrically-lossy materials include carbon or graphite formed as fibers, flakes, or other particles. Metal in the form of powder, flakes, fibers, or other conductive particles may also be used to provide suitable electrically-lossy properties. Alternatively, combinations of fillers may be used. For example, metal plated (or coated) particles may be used. Silver and nickel may also be used to plate particles. Plated (or coated) particles may be used alone or in combination with other fillers, such as carbon flake. In some embodiments, the fillers will be present in a sufficient volume percentage to allow conducting paths to be created from particle to particle. For example, when metal fiber is used, the fiber may be present in up to 40% by volume or more.

As used herein, the term "binder" encompasses a material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connectors. The thermoplastic material may facilitate the molding of the electrically-lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used.

A magnetically-lossy layer may be formed of a binder material with magnetic particles dispersed therein. The magnetically-lossy particles may be in any convenient form, such as flakes or fibers. Ferrites are common magnetically-lossy materials. Materials such as magnesium ferrite, nickel ferrite, lithium ferrite, yttrium garnet or aluminum garnet may be used alternatively or additionally. The magnetic material will generally have a magnetic loss tangent above 1.0 at the frequency range of interest. Materials with higher loss tangents may also be used.

It should be understood that, in some embodiments, the material may simultaneously be an electrically-lossy material and a magnetically-lossy material. Such materials can be formed, for example, by using magnetically-lossy fillers that are partially conductive or by using a combination of magnetically-lossy and electrically-lossy fillers.

Figure 4:
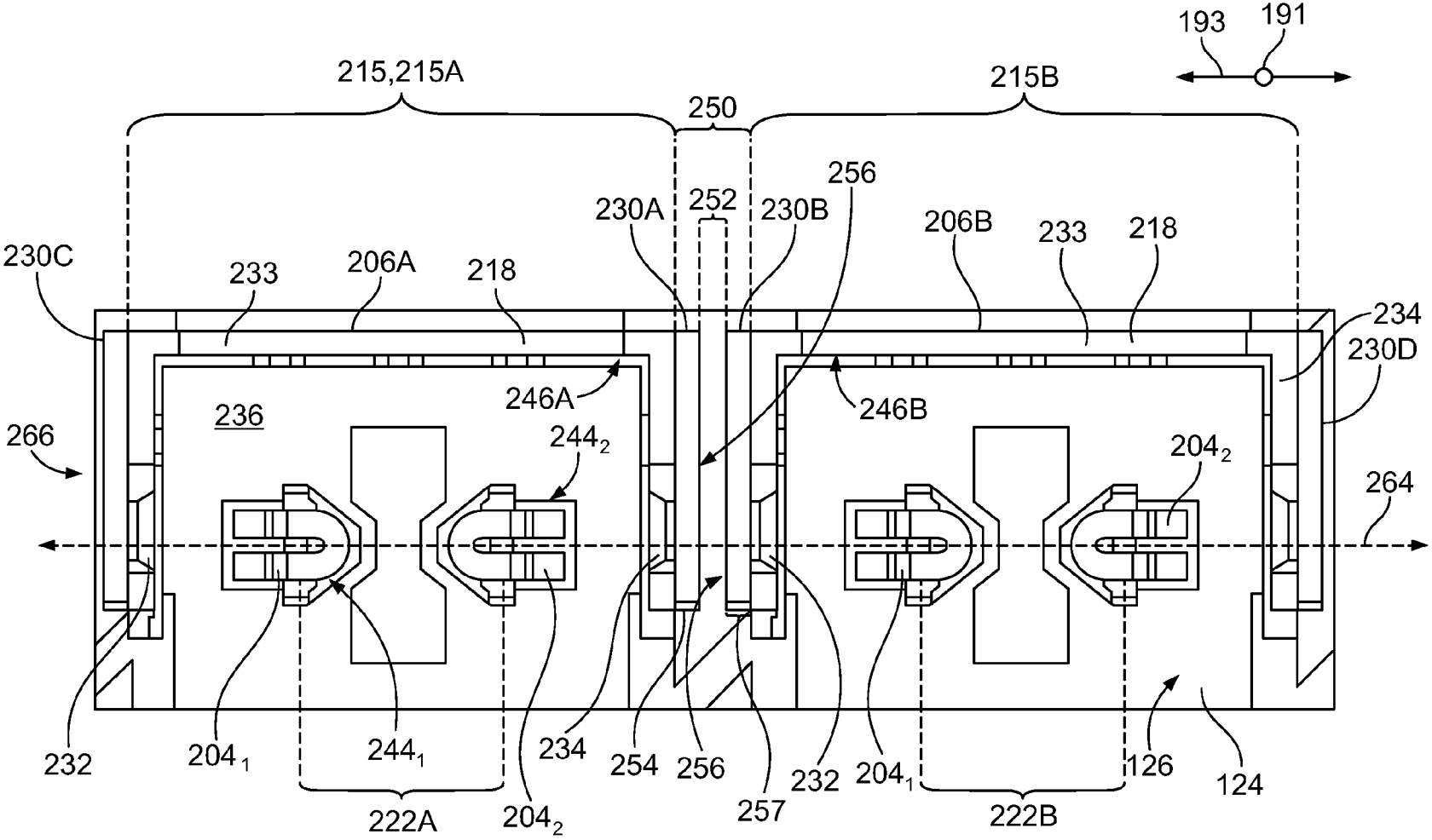
FIG. 4 is an enlarged front view of a portion of the header connector of FIG. 1 illustrating adjacent signal pairs and corresponding ground conductors with resonance-control elements attached thereto.

FIG. 4 is an enlarged front view of a portion of the electrical connector 108 (FIG. 1) illustrating adjacent conductor sub-assemblies 215A, 215B. Although the following is with specific reference to two conductor sub-assemblies 215A, 215B, it should be understood that some or all of the remaining conductor sub-assemblies 215 (FIG. 3) of the conductor array 202 (FIG. 3) may have similar features and/or relationships with other adjacent conductor sub-assemblies 215. For example, the conductor sub-assemblies 215A, 215B may form part of one of the rows 266 of the conductor array 202 that extends parallel to the second lateral axis 193. The conductor sub-assembly 215A includes a signal pair 222A and an intervening ground conductor 206A, and the conductor sub-assembly 215B includes a signal pair 222B and an intervening ground conductor 206B. As shown, the conductor assemblies 215 of the row 266 are co-planar such that the intervening ground conductors 206A, 206B and the signal pairs 222A, 222B are aligned along a common plane 264 that extends parallel to the mating axis 191 and the second lateral axis 193.

In the illustrated embodiment, the intervening ground conductors 206A, 206B or, more specifically, the ground shields 218 of the intervening ground conductors 206A, 206B at least partially surround the signal pairs 222A, 222B, respectively. In this context, the phrase "at least partially surround" includes the intervening ground conductor (or intervening ground conductors) of the conductor sub-assembly surrounding at least two contiguous sides of the signal pair of the conductor sub-assembly. For example, in the illustrated embodiment, the intervening ground conductor 206A surrounds about three sides of the signal pair 222A, and the intervening ground conductor 206B surrounds about three sides of the signal pair 222B. More specifically, the ground shields 218 are shaped to form three conductor walls 232, 233, 234 that are positioned around the corresponding signal pair. For example, the conductor walls 232-234 of the intervening ground conductor 206A are coupled to each other and positioned to surround three sides of the signal pair 222A. The conductor walls 232-234 define a signal cavity 236 having the corresponding signal pair 222A disposed therein. In an exemplary embodiment, the conductor walls 232-234 are stamped and formed from a common piece of sheet metal. In other embodiments, the conductor walls 232-234 may be separate ground conductors (or ground blades) that are positioned to at least partially surround the corresponding signal pair. The conductor walls 232, 234 may be referred to as side conductor walls, and the conductor wall 233 may be referred to as a center conductor wall.

The signal pairs 222A, 222B are adjacent signal pairs. Each of the signal pairs 222A, 222B includes first and second signal conductors $\mathbf{204}_1$, $\mathbf{204}_2$ that extend parallel to each other along the mating axis 191. As shown, the intervening ground conductors 206A, 206B extend through ground cavities 246A, 246B, respectively, of the connector body 124, and the first and second signal conductors $\mathbf{204}_1$, $\mathbf{204}_2$ of each of the signal pairs 222A, 222B extend through respective signal cavities $\mathbf{244}_1$, $\mathbf{244}_2$ of the connector body 124. In the illustrated embodiment, the ground cavities 246A, 246B are sized and shaped such that the intervening ground conductors 206A, 206B, respectively, may be inserted into the ground cavities 246A, 246B, respectively, in a direction along the mating axis 191. For example, the ground conductors 206A, 206B may be inserted into the ground cavities 246A, 246B, respectively, in a direction that is from the mounting side 128 (FIG. 1) to the front side 126 of the connector body 124. The intervening ground conductors 206A, 206B may form an interference fit with the connector body 124.

Likewise, the signal cavities $\mathbf{244}_1$, $\mathbf{244}_2$ are sized and shaped such that the signal conductors $\mathbf{204}_1$, $\mathbf{204}_2$ may be inserted into the signal cavities $\mathbf{244}_1$, $\mathbf{244}_2$, respectively, in a direction along the mating axis 191. In such embodiments, the signal conductors $\mathbf{204}_1$, $\mathbf{204}_2$ may form an interference fit with the connector body 124. In alternative embodiments, the connector body 124 may be molded around the signal conductors $\mathbf{204}_1$, $\mathbf{204}_2$ and the intervening ground conductors 206A, 206B.

As shown in FIG. 4, portions of the intervening ground conductors 206A, 206B are positioned between the adjacent signal pairs 222A, 222B. More specifically, the conductor wall 234 of the intervening ground conductor 206A and the conductor wall 232 of the intervening ground conductor 206B are positioned between the adjacent signal pairs 222A, 222B. For embodiments that do not include signal pairs, the intervening ground conductors 206A, 206B may be positioned between two adjacent signal conductors, such as the signal conductor $\mathbf{204}_2$ of the conductor sub-assembly 215A and the signal conductor $\mathbf{204}_1$ of the conductor sub-assembly 215B.

In the illustrated embodiment, the intervening ground conductors 206A, 206B or, more specifically, the conductor walls 234, 232 of the intervening ground conductors 206A, 206B, respectively, are separated from each other by a physical gap 250. During operation of the electrical connector 108, electrical energy may radiate from the signal conductors 204, 244 and into the gap 250. By way of example, the gap 250 may be less than 4 millimeters (mm) in some embodiments. In certain embodiments, the gap 250 may be less than 3 mm or, more particularly, less than 2 mm. In particular embodiments, the gap 250 may be less than 1.5 mm or, more particularly, less than 1 mm.

As shown, resonance-control elements 230A, 230B directly interface with the intervening ground conductors 206A, 206B, respectively. More specifically, the resonance-control elements 230A, 230B are attached to the conductor walls 234, 232 of the intervening ground conductors 206A, 206B, respectively. In the illustrated embodiment, the resonance-control elements 230A, 230B are secured to the intervening ground conductors 206A, 206B, respectively, such that the resonance-control elements 230A, 230B may not be readily removed therefrom. For example, the resonance-control elements 230A, 230B may be affixed to the intervening ground conductors 206A, 206B, respectively. In particular embodiments, the resonance-control elements 230A, 230B are molded onto or coated onto (e.g., painted onto) the ground conductors 206A, 206B, respectively. For example, the electrically-lossy and/or magnetically-lossy material may comprise an epoxy having conductive particles dispersed therein. The conductive epoxy may be coated or painted onto the intervening ground conductors 206A, 206B. In other embodiments, a conductive adhesive may be used to secure the resonance-control elements 230A, 230B to the intervening ground conductors 206A, 206B, respectively. Yet in other embodiments, the electrically-lossy and/or magnetically-lossy material may be attached to the intervening ground conductors 206A, 206B during a molding process.

The resonance-control elements 230A, 230B are spaced from each other such that a gap portion 252 of the larger gap 250 exists between the resonance-control elements 230A, 230B. As shown, the gap portion 252 includes air such that the resonance-control elements 230A, 230B are separated by air. During operation of the electrical connector 108, however, a dielectric material of the front housing 120 (FIG. 1) of the electrical connector 112 (FIG. 1) may be disposed within the gap portion 252. In some embodiments, the gap portion 252 of the larger gap 250 may be about one-quarter to about three-quarters the size of the larger gap 250. In the illustrated embodiment, the gap portion 252 is about one-third the size of the larger gap 250.

In the illustrated embodiment, each of the first and second resonance-control elements 230A, 230B includes a pad or block 254 of the electrically-lossy and/or magnetically-lossy material. The pads 254 of the resonance-control elements 230A, 230B have outer surfaces 256 that face each other and extend parallel to each other with the gap portion 252 of the larger gap 250 therebetween. The outer surfaces 256 may be essentially planar. The pads 254 may have identical dimensions with respect to each other. As shown, each of the pads 254 has a thickness 257 that is substantially uniform. In other embodiments, the pads 254 may not have identical dimensions and/or may have a thickness that is not substantially uniform.

Also shown, resonance-control elements 230C, 230D directly interface with the intervening ground conductors 206A, 206B, respectively. More specifically, the resonance-control elements 230C, 230D are attached to the conductor walls 232, 234 of the intervening ground conductors 206A, 206B, respectively. Accordingly, each of the intervening ground conductors 206A, 206B may have separate resonance control elements 230 attached to the opposing conductor walls 232, 234. In the illustrated embodiment, the conductor wall 233 does not have a resonance-control element attached thereto. In other embodiments, however, a resonance-control element may be attached to the outside of conductor wall 233. The resonance-control elements 230C, 230D may have similar relationships with adjacent resonance-control elements 230 (not shown in FIG. 4) as described above with respect to the adjacent resonance-control elements 230A, 230B. For example, a gap portion that is similar to the gap portion 252 may exist between the resonance-control element 230C and an adjacent resonance-control element 230.

When the electrical connector 108 is unmated with the electrical connector 112, the resonance-control elements 230A, 230B are exposed in the exterior of the connector body 124. For example, the resonance-control elements 230A, 230B may be located within the receiving space 174 (FIG. 3).

Returning briefly to FIG. 3, the ground conductors 206 have a length 259 that is measured between a leading end 258 and a trailing end 260 of the corresponding ground conductor 206. In certain embodiments, the resonance-control elements 230 only cover a portion of the lengths 259 of the ground conductors 206. For example, the resonance-control elements 230 may extend from the leading end 258 to the front side 126. In some embodiments, the resonance-control elements 230 have a length 262 that is within a range from about one-quarter of the length 259 to about the entire length 259 of the corresponding ground conductor 206. In certain embodiments, the length 262 may be about one-third of the length 259 to about three-quarters of the length 259. In particular embodiments, the length 262 may be about one-half of the length 259 to about three-quarters of the length 259.

Figure 5:
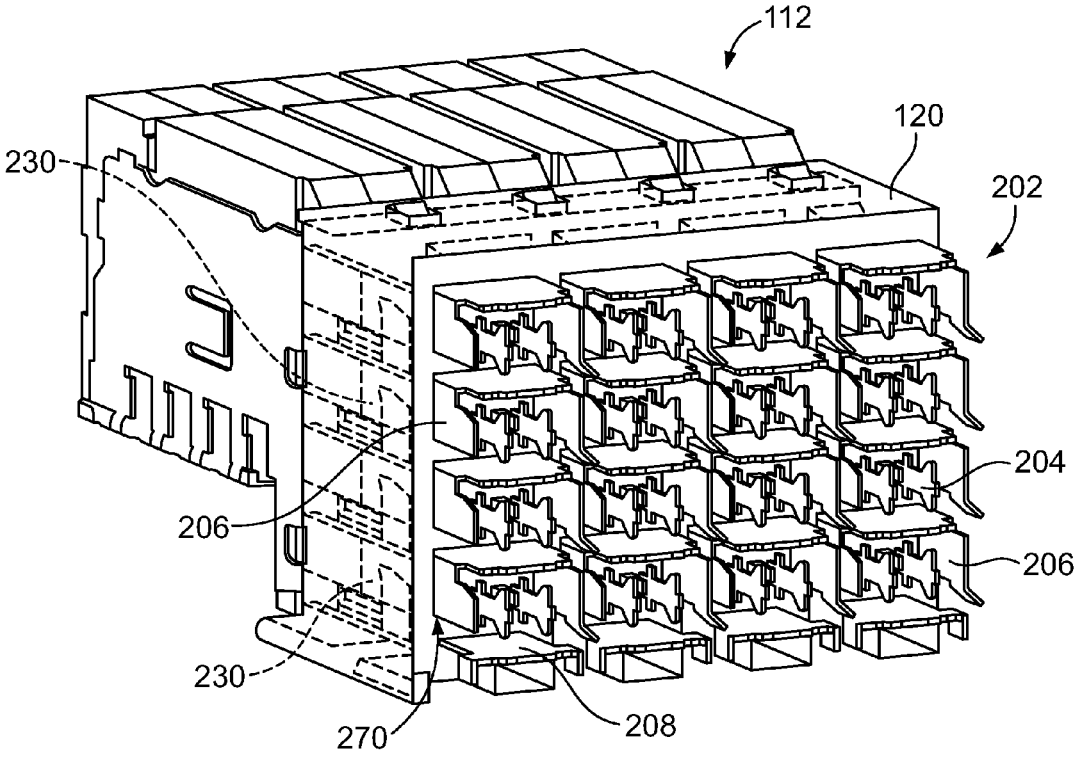
FIG. 5 is a perspective view of the receptacle connector when mated with the conductor array of FIG. 3. A connector body of the header connector has been removed for illustrative purposes.

FIG. 5 is a front perspective view of the electrical connector 112 when mated with the conductor array 202 of the electrical connector 108 (FIG. 1). For illustrative purposes, the connector body 124 (FIG. 1) of the electrical connector 108 has been removed and the front housing 120 of the electrical connector 112 is shown in phantom. FIG. 5 shows the conductor array 202 mated with the electrical connector 112. The front housing 120 includes an array of contact channels 270 that are configured to receive the signal conductors 204 and the ground conductors 206, 208. Although not shown, the electrical connector 112 includes signal contacts and ground contacts disposed within corresponding contact channels 270 that engage the signal conductors 204 and the ground conductors 206, 208, respectively.

Figure 7:
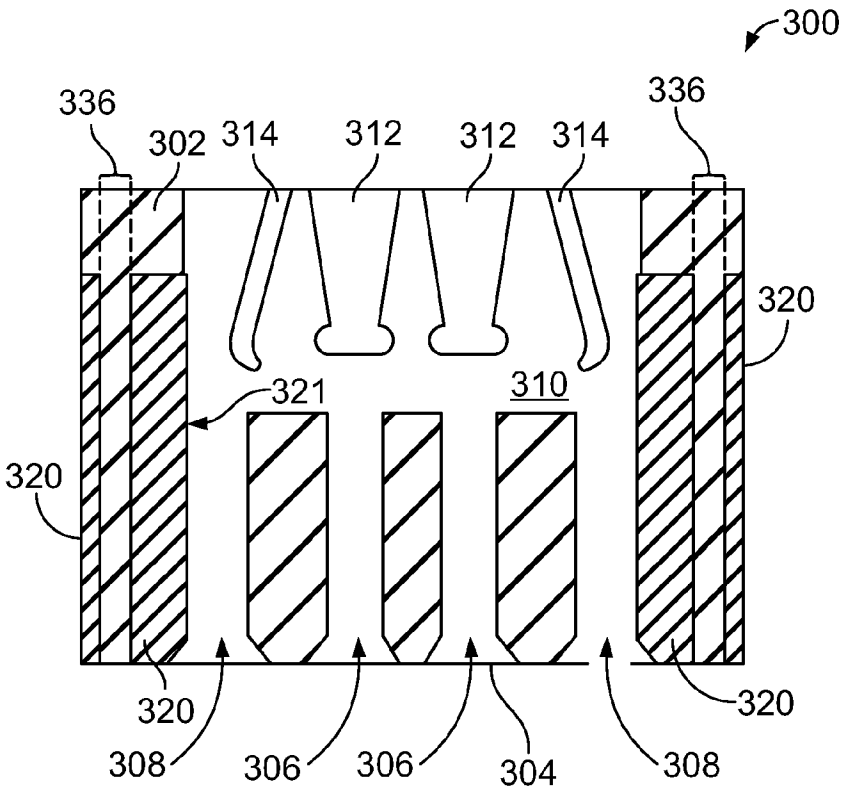
FIG. 7 is a cross-section of a portion of an electrical connector formed in accordance with an embodiment and illustrates resonance-control elements that are formed with a front housing of the electrical connector.

The front housing 120 of the electrical connector 112 is shown in phantom to illustrate the resonance-control elements 230. As described herein, the resonance-control elements 230 may be affixed to the corresponding ground conductors 206. In alternative embodiments, however, the front housing 120 may be manufactured to include resonance-control elements that are similar or identical to the resonance-control elements 230 and have positions that are similar to the positions of the resonance-control elements 230 shown in FIG. 5. For example, the front housing 120 may be formed through a "two-shot" injection-molding process in which a portion of the front housing 120 is formed from only dielectric material during a first molding process and other portions of the front housing 120 are formed from electrically-lossy and/or magnetically-lossy material during a second molding process. The electrically-lossy and/or magnetically-lossy material may form the alternative resonance-control elements. These resonance-control elements may define a portion of the contact channels 270 that receive the ground conductors 206. FIG. 7, described below, illustrates such alternative resonance-control elements in greater detail.

Figure 6:
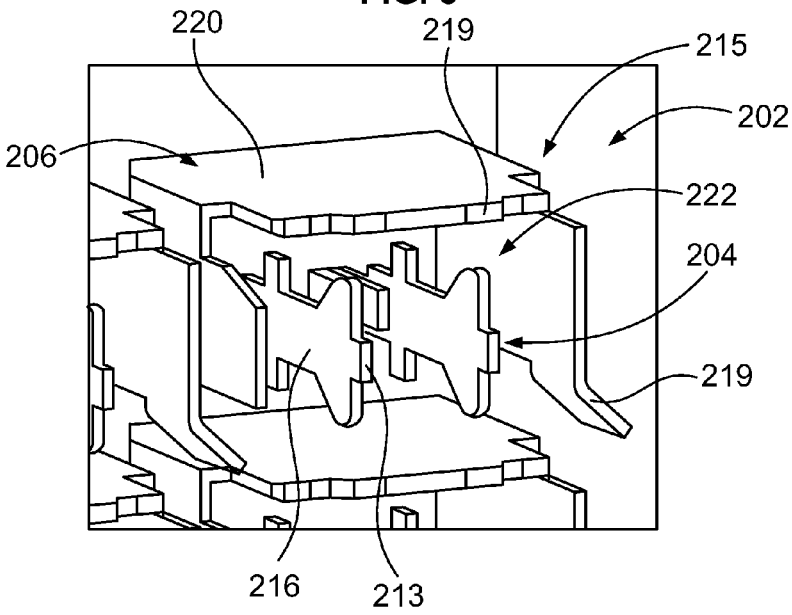
FIG. 6 is an enlarged view of a conductor sub-assembly of the header connector of FIG. 1.

FIG. 6 is an enlarged perspective view of a portion of the conductor array 202 as shown in FIG. 5 and, in particular, illustrates an exemplary conductor sub-assembly 215. FIG. 6 illustrates exemplary body portions 216 and signal terminals 213 of the signal conductors 204 for one signal pair 222. FIG. 6 also illustrates the body portion 220 and ground terminals 219 of the ground conductor 206 that surrounds the signal pair 222. The ground terminals 219 may include edges of the ground conductors 206. Each of the signal terminals 213 may be configured to engage a respective thru-hole (not shown) of the circuit board 106 (FIG. 1). Each of the ground terminals 219 may be configured to engage a respective via (not shown) of the circuit board 106. As such, the signal and ground conductors 204, 206 may be mechanically and electrically coupled to the circuit board 106.

FIG. 7 is a cross-section of a portion of an electrical connector 300 formed in accordance with an embodiment. The electrical connector 300 may be similar to the electrical connector 112 (FIG. 1) and be part of an interconnection system (not shown), such as the interconnection system 100 (FIG. 1). In certain embodiments, the electrical connector 300 is a receptacle connector of a daughtercard interconnection system. As shown in FIG. 7, the electrical connector 300 includes a front housing or shroud 302 having a front side 304. The front side 304 is configured to interface with another electrical connector, such as an electrical connector that is similar to the electrical connector 108 (FIG. 1). The front housing 302 includes a plurality of contact channels 306, 308 that open to the front side 304. The contact channels 306 are hereinafter referred to as signal channels 306, and the contact channels 308 are hereinafter referred to as ground channels 308. In an exemplary embodiment, the two ground channels 308 shown in FIG. 7 are portions of a single ground channel. The signal and ground channels 306, 308 extend from the front side 304 into a common contact cavity 310.

The electrical connector 108 also includes signal contacts 312 and ground contacts 314 that are disposed within the front housing 302. The signal and ground contacts 312, 314 may be similar to the contact beams 152 and the ground contacts 153, respectively, shown in FIG. 2. The signal contacts 312 are aligned with the signal channels 306, and the ground contacts 314 are aligned with the ground channels 308.

The electrical connector 300 may also include resonance-control elements 320. The resonance-control elements 320 may be similar to the resonance-control elements 230 (FIG. 3) and comprise at least one of an electrically-lossy or magnetically-lossy material as described herein. The resonance-control elements 320 partially define the ground channels 308 such that a surface 321 of each resonance-control element 320 is exposed within the ground channel 308.

The resonance-control elements 320 may be formed with the front housing 302. For example, the front housing 302 may be formed using a two-shot injection molding process as described herein. Alternatively, the resonance-control elements 320 may be positioned within the front housing 302 after the front housing 302 is formed. Also shown, each resonance-control element 320 may be spaced-apart or separated from an adjacent resonance-control element 320 by a gap 336. The gap 336 may be similar to the gap portion 252 (FIG. 4) and have similar gap sizes. In the illustrated embodiment, a portion of the dielectric material that forms the front housing 302 is disposed between the adjacent resonance-control elements 320.

Figure 8:
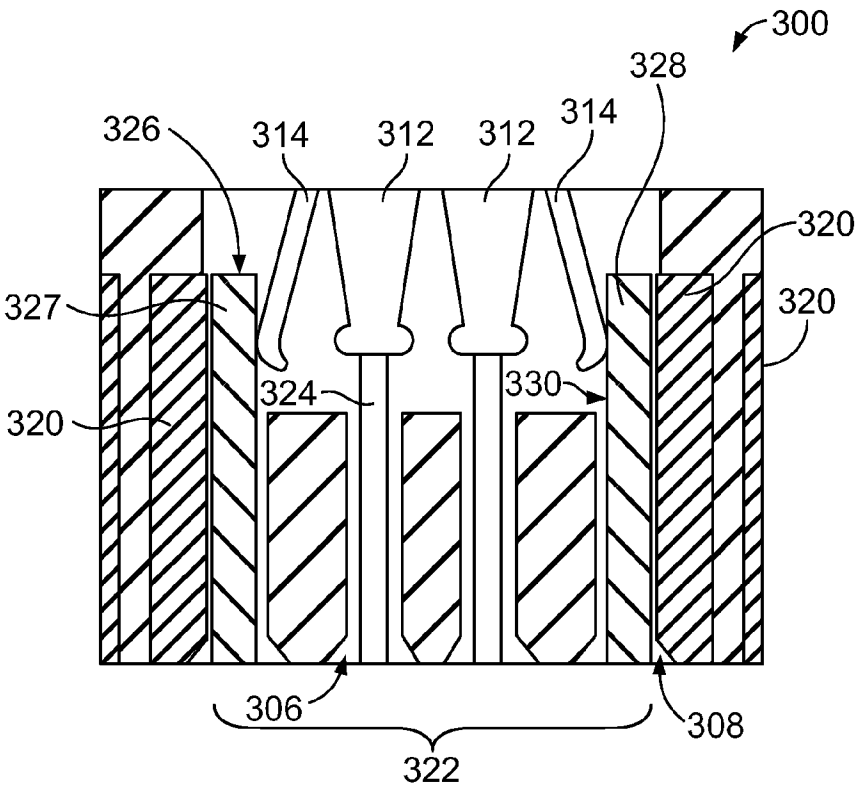
FIG. 8 is a cross-section of the electrical connector of FIG. 7 when the resonance-control elements directly interface with a ground conductor.

FIG. 8 is a cross-section of a portion of the electrical connector 300 after a conductor sub-assembly 322 of a mating connector (not shown) has been inserted into the contact channels 306, 308. The conductor sub-assembly 322 may be similar to the conductor sub-assembly 215 (FIG. 3) of the electrical connector 108 (FIG. 1). For example, the conductor sub-assembly 322 includes signal contacts (or signal conductors) 324 and a ground shield (or ground conductor) 326. The ground shield 326 may be C-shaped, U-shaped, or L-shaped. As such, FIG. 8 shows two conductor walls 327, 328 of the same ground shield 326. Although not shown, the conductor walls 327, 328 are joined by another conductor wall. Each of the signal contacts 324 is configured to be inserted into one of the signal channels 306, and the ground shield 326 is configured to be inserted into the ground channels 308. For embodiments that receive C-shaped or U-shaped ground shields 326, the contact channels 308 may be part of a common C-shaped or U-shaped contact channel.

As shown in FIG. 8, each of the conductor walls 327, 328 directly interfaces with a corresponding resonance-control element 320. For example, each of the conductor walls 327, 328 may engage the corresponding resonance-control element 320 and/or a nominal tolerance gap may exist between the resonance-control element 320 and the corresponding conductor wall. Also shown in FIG. 8, the ground contacts 314 are deflected by the ground shield 326 and engage corresponding inner surfaces 330 of the conductor walls 327, 328. The signal contacts 312 may engage corresponding signal contacts 324 of the conductor sub-assembly 322.

Figure 9:
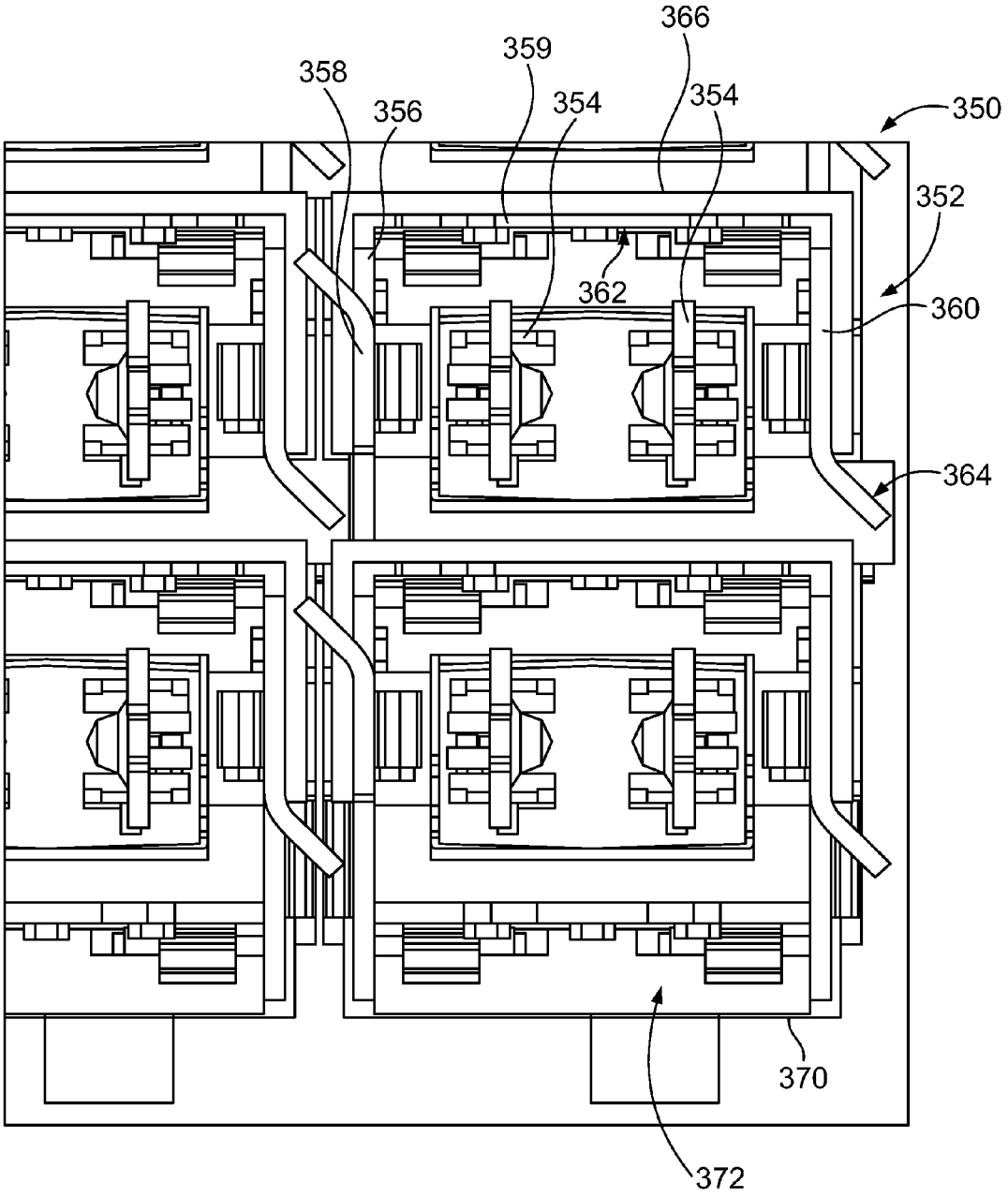
FIG. 9 is an enlarged back view of a conductor array formed in accordance with an embodiment that is mated with a receptacle connector.

FIG. 9 is an enlarged back view of a conductor array 350 that is engaged or mated with an electrical connector 370. FIG. 9 shows a front side 372 of the electrical connector 370, which may be similar or identical to the electrical connector 112 (FIG. 1). The conductor array 350 includes a plurality of conductor sub-assemblies 352. The conductor array 350 may be part of, for example, another electrical connector (not shown) that is similar to the electrical connector 108 (FIG. 1). For illustrative purposes, a connector body of the other electrical connector is not shown, but it should be understood that the conductor sub-assemblies 352 are at least partially disposed within a connector body, such as the connector body 124 (FIG. 1).

Each conductor sub-assembly 352 includes signal conductors 354 and a ground conductor 356, which may be similar or identical to the signal conductors 204 and the ground conductors 206, respectively, shown in FIG. 3. The ground conductors 356 may include conductor walls 358, 359, 360. Each of the ground conductors 356 has an inner surface 362 and an outer surface 364. As shown in FIG. 9, the outer surface 364 has a resonance-control element 366 attached thereto. The resonance-control element 366 is coupled to each of the conductor walls 358-360 such that the resonance-control element 366 is also U-shaped or C-shaped.

Figure 10:
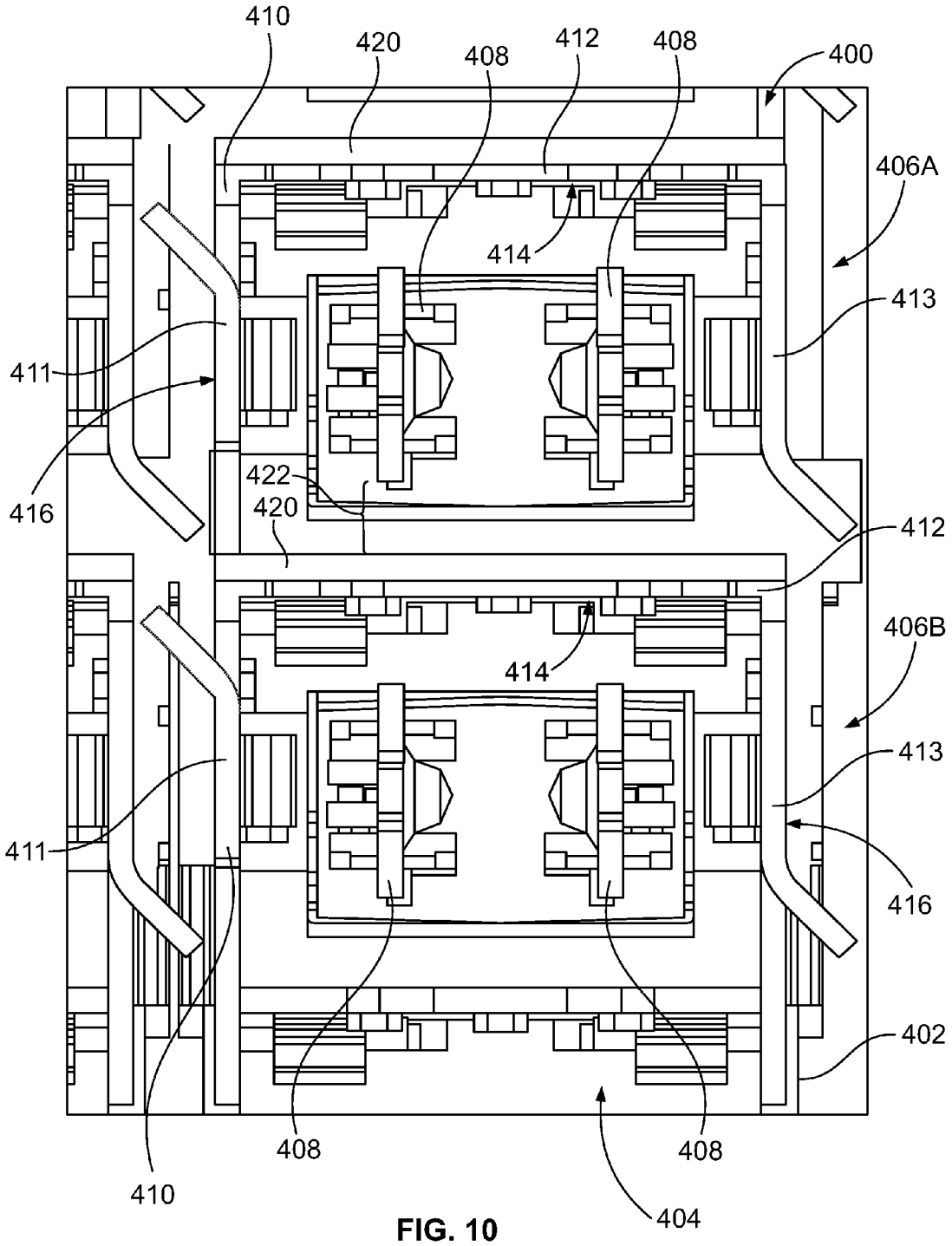
FIG. 10 is an enlarged back view of a conductor array formed in accordance with an embodiment that is engaged or mated with a receptacle connector.

FIG. 10 is an enlarged back view of a conductor array 400 that is engaged or mated with an electrical connector 402. FIG. 10 shows a front side 404 of the electrical connector 402, which may be similar or identical to the electrical connector 112 (FIG. 1). The conductor array 400 includes a plurality of conductor sub-assemblies 406A, 406B. Although only two conductor sub-assemblies 406A, 406B are referenced, the conductor array 400 may include numerous conductor sub-assemblies. The conductor array 400 may be part of, for example, another electrical connector (not shown) that is similar to the electrical connector 108 (FIG. 1). For illustrative purposes, a connector body of the other electrical connector is not shown, but it should be understood that the conductor sub-assemblies 406A, 406B are at least partially disposed within a connector body, such as the connector body 124 (FIG. 1).

Each of the conductor sub-assemblies 406A, 406B includes signal conductors 408 and a ground conductor 410, which may be similar or identical to the signal conductors 204 and the ground conductors 206, respectively, shown in FIG. 3. The ground conductors 410 may include conductor walls 411, 412, 413. The conductor walls 411, 413 may be referred to as side conductor walls, and the conductor wall 412 may be referred to as a center conductor wall. Each of the ground conductors 410 has an inner surface 414 and an outer surface 416.

As shown in FIG. 10, a resonance-control element 420 directly interfaces with the outer surface 416 along the center conductor wall 412 of the intervening ground conductors 406A, 406B. The resonance control elements 420 of one conductor sub-assembly are spaced from the signal conductors 408 of the adjacent conductor sub-assembly. For example, the resonance-control element 420 that directly interfaces with the intervening ground conductor 410 of the conductor sub-assembly 406B is spaced from the pair of signal conductors 408 of the conductor sub-assembly 406A such that a physical gap 422 exists therebetween. The physical gap 422 may be configured to reduce or minimize the likelihood that the resonance-control element 420 may negatively affect signal integrity. Unlike the embodiment of FIG. 9, however, the side conductor walls 411, 413 are devoid of resonance-control elements. In other embodiments, one or both of the side conductor walls 411, 413 may directly interface with a corresponding resonance-control element.

In alternative embodiments, the ground conductors 410 may be shaped such that the center conductor wall 412 is located closer to the signal conductors 408 of the adjacent conductor sub-assembly than shown in FIG. 10. In such embodiments, the resonance-control element 420 may be positioned to directly interface with the inner surface 414 along the center conductor wall 412 of the corresponding ground conductor 410. Likewise, in alternative embodiments, the ground conductors 410 may be shaped such that one or both of the side conductor walls 411, 413 is/are located closer to the signal conductors 408 of the adjacent conductor sub-assembly than shown in FIG. 10. In such embodiments, the resonance-control element (not shown) may be positioned to directly interface with the inner surface 414 along the corresponding side conductor wall.

Accordingly, embodiments set forth herein include electrical connectors having conductor arrays. The conductor arrays include a plurality of signal conductors and a plurality of ground conductors that extend through the connector body. The conductor array may be a two-dimensional array that include signal conductors (or signal pairs) that are horizontally-aligned and signal conductors (or signal pairs) that are vertically-aligned. In some embodiments, an intervening ground conductor may be positioned between adjacent signal conductors (or signal pairs) that are vertically-aligned or adjacent signal conductors (or signal pairs) that are horizontally-aligned. The electrical connector may have a resonance-control element that directly interfaces with the intervening ground conductor. The resonance-control element may be positioned on either side of the intervening ground conductor. The resonance-control element may be spaced from other resonance-control elements and spaced from the signal conductors. As set forth herein, the resonance-control element includes at least one of an electrically-lossy or magnetically-lossy material. As shown in FIGS. 9 and 10, in some embodiments, adjacent signal conductors (or signal pairs) have only one intervening ground conductor therebetween. In other embodiments, as shown in FIG. 4, the adjacent signal conductors (or signal pairs) have more than one intervening ground conductor therebetween, such as two intervening ground conductors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector body having a front side configured to engage a mating connector during a mating operation and a mounting side configured to engage an electrical component;

a conductor array including a plurality of signal conductors and a plurality of ground conductors that extend through the connector body to interconnect the mating connector and the electrical component, wherein the plurality of signal conductors include adjacent signal conductors and the plurality of ground conductors include first and second ground conductors that are positioned between the adjacent signal conductors, the first and second ground conductors being separated from each other by a physical gap; and a resonance-control element positioned between the first and second ground conductors within the physical gap, the resonance-control element directly interfacing with the first ground conductor and being spaced from the second ground conductor, the resonance-control element having an outer surface that faces the second ground conductor and is exposed to air in front of the front side, the resonance-control element positioned to be received by the mating connector during the mating operation, the resonance-control element including at least one of an electrically-lossy or magnetically-lossy material.

2. The electrical connector of claim 1, wherein the resonance-control element is a first resonance-control element, the electrical connector further comprising a second resonance-control element that directly interfaces with the second ground conductor, the second resonance-control element having an outer surface that faces the first ground conductor and is exposed to the air in front of the front side, the first and second resonance-control elements being spaced from each other with the air therebetween.

3. The electrical connector of claim 2, wherein each of the first and second resonance-control elements includes a pad of the electrically-lossy and/or magnetically-lossy material.

4. The electrical connector of claim 1, wherein the signal conductors form a plurality of signal pairs that are configured to carry differential signals, the first and second ground conductors being positioned between adjacent signal pairs.

5. The electrical connector of claim 4, wherein the conductor array includes a plurality of conductor sub-assemblies, each conductor sub-assembly including one of the signal pairs and at least one of the ground conductors.

6. The electrical connector of claim 4, wherein the conductor array includes a plurality of conductor sub-assemblies, each of the conductor sub-assemblies including one of the signal pairs and one of the ground conductors, the one ground conductor of a respective conductor sub-assembly being shaped to at least partially surround the one signal pair of the respective conductor sub-assembly.

7. The electrical connector of claim 1, wherein the signal and ground conductors include signal contacts and ground shields, respectively, that project from the front side of the connector body into an exterior of the connector body, the resonance-control element directly interfacing with the ground shield of the first ground conductor in the exterior of the connector body.

8. The electrical connector of claim 1, wherein the resonance-control element is one of coated onto the first ground conductor, molded with the connector body, or molded directly onto the first ground conductor, wherein the resonance-control element comprises a dielectric material having conductive and/or magnetic particles dispersed within the dielectric material.

9. An electrical connector comprising:

a connector body having a front side configured to engage a mating connector during a mating operation and a mounting side configured to engage an electrical component;

a conductor array including a plurality of signal conductors and a plurality of ground conductors that extend through the connector body to interconnect the mating connector and the electrical component, wherein the plurality of signal conductors include adjacent signal conductors and the plurality of ground conductors include an intervening ground conductor that is positioned between the adjacent signal conductors; and a resonance-control element directly interfacing with the intervening ground conductor and being positioned between and spaced from the adjacent signal conductors, the resonance-control element having an outer surface that is exposed to air in front of the front side, the resonance-control element positioned to be received by the mating connector during the mating operation, the resonance-control element being spaced from the other ground conductors and including at least one of an electrically-lossy or magnetically-lossy material.

10. The electrical connector of claim 9, wherein the signal conductors form a plurality of signal pairs that are configured to carry differential signals, the intervening ground conductor and the resonance-control element being positioned between adjacent signal pairs.

11. The electrical connector of claim 10, wherein the conductor array includes a plurality of conductor sub-assemblies, each conductor sub-assembly including one of the signal pairs and at least one of the ground conductors.

12. The electrical connector of claim 10, wherein the conductor array includes a plurality of conductor sub-assemblies, each of the conductor sub-assemblies including one of the signal pairs and one of the ground conductors, the one ground conductor of a respective conductor sub-assembly being shaped to at least partially surround the one signal pair of the respective conductor sub-assembly.

13. The electrical connector of claim 9, wherein the signal and ground conductors include signal contacts and ground shields, respectively, that project from the front side of the connector body into an exterior of the connector body, the resonance-control element directly interfacing with the ground shield of the intervening ground conductor in the exterior of the connector body.

14. The electrical connector of claim 9, wherein the resonance-control element is one of coated onto the first ground conductor, molded with the connector body, or molded directly onto the first ground conductor, wherein the resonance-control element comprises a dielectric material having conductive and/or magnetic particles dispersed within the dielectric material.

15. An electrical connector comprising:

a front housing having a front side configured to engage a mating connector, the front housing comprising a dielectric material and including signal and ground channels that open to the front side;

signal and ground contacts disposed within the front housing and aligned with the signal and ground channels, respectively, for engaging signal and ground conductors, respectively, of the mating connector in which the signal contacts and signal conductors communicate data signals therebetween; and resonance-control elements comprising an electrically-lossy and/or magnetically-lossy material, the resonance-control elements partially defining the ground channels such that an outer surface of each resonance-control element is exposed to air within the corresponding ground channel, wherein the outer surface of each of the resonance-control elements is configured to slidably engage a corresponding ground conductor of the mating connector, the resonance-control elements being spaced apart from one another.

16. The electrical connector of claim 15, wherein each of the resonance-control elements comprises a dielectric material having conductive and/or magnetic particles dispersed within the dielectric material of the corresponding resonance-control element.

17. The electrical connector of claim 15, wherein the resonance-control elements are molded with the front housing.

18. The electrical connector of claim 15, wherein at least some of the ground channels are C-shaped, U-shaped, L-shaped, or rectangular.

19. The electrical connector of claim 15, wherein the front side of the front housing faces in a mating direction, the outer surface facing in a direction that is perpendicular to the mating direction, the signal and ground channels configured to receive the signal and ground conductors, respectively, as the signal and ground conductors advance in a direction that is opposite the mating direction.

20. The electrical connector of claim 1, wherein the front side of the connector body faces in a mating direction, the outer surface facing in a direction that is perpendicular to the mating direction and configured to slidably engage the mating connector.

* * * * *